US005830085A

United States Patent [19]

Higuchi et al.

[11] Patent Number: 5,830,085

[45] Date of Patent: Nov. 3, 1998

[54] THREE-PIECE SOLID GOLF BALL

[75] Inventors: Hiroshi Higuchi; Hisashi Yamagishi; Yasushi Ichikawa, all of Chichibu, Japan

[73] Assignee: Bridgestone Sports Co., Ltd., Tokyo, Japan

[21] Appl. No.: 821,438

[22] Filed: Mar. 21, 1997

[30] Foreign Application Priority Data

Mar. 29, 1996 [JP] Japan ..... 8-104307
Jul. 18, 1996 [JP] Japan ..... 8-207869

[51] Int. Cl.[6] ..... A63B 37/06

[52] U.S. Cl. ..... 473/373; 473/374; 473/378

[58] Field of Search ..... 473/373, 374, 473/378

[56] References Cited

U.S. PATENT DOCUMENTS 4,714,253 12/1987 Nakahara et al. ..... 473/373
5,184,828 2/1993 Kim et al. ..... 473/373 X
5,553,852 9/1996 Higurhi et al. ..... 473/373

*Primary Examiner*—George J. Marlo
*Attorney, Agent, or Firm*—Sughrue, Mion, Zinn, Macpeak & Seas, PLLC

[57] ABSTRACT

The invention provides a three-piece solid golf ball having improved flight performance, durability, soft pleasant hitting feel, and controllability. To this end, in a three-piece solid golf ball of the three-layer structure comprising a solid core, an intermediate layer, and a cover, the solid core, intermediate layer, and cover each have a hardness as measured by a JIS-C scale hardness meter wherein the core center hardness is up to 75 degrees, the core surface hardness is up to 85 degrees, the core surface hardness is higher than the core center hardness by 5 to 25 degrees, the intermediate layer hardness is higher than the core surface hardness by less than 10 degrees, and the cover hardness is higher than the intermediate layer hardness.

13 Claims, 1 Drawing Sheet

THREE-PIECE SOLID GOLF BALL

This application stems from and claims priority from the provisional application Ser. No. 60/025,418 filed Sep. 4, 1996.

BACKGROUND OF THE INVENTION

1. Field of the Invention

This invention relates to-a three-piece solid golf ball of the three-layer structure comprising a solid core, an intermediate layer, and a cover more particularly it relates to a three-piece solid golf ball which is imparted excellent flight performance, durability, pleasant hitting feel, and controllability and hence, all-around performance by optimizing the hardness distribution of the core and the overall hardness distribution of the ball including the core, intermediate layer, and cover.

2. Prior Art

In the past, golf balls of various structures have been on the market. Among others, two-piece solid golf balls having a rubber base core enclosed with a cover of ionomer resin or the like and thread-wound golf balls comprising a wound core having thread rubber wound around a solid or liquid center and a cover enclosing the core share the majority of the market.

Most amateur golfers are fond of two-piece solid golf balls which have excellent flying performance and durability although these balls have the disadvantages of a very hard feel on hitting and low control due to quick separation from the club head on hitting. For this reason, many professional golfers and skilled amateur golfers prefer wound golf balls to two-piece solid golf balls. The wound golf balls are superior in feeling and control, but inferior in carry and durability to the two-piece solid golf balls.

Under the present situation that two-piece solid golf balls and wound golf balls have contradictory characteristics as mentioned above, players make a choice of golf balls depending on their own skill and taste.

In order to develop solid golf balls having a feel approximate to the wound golf balls, various two-piece solid golf balls of the soft type have been proposed. To obtain such two-piece solid golf balls of the soft type, soft cores are used. Softening the core can reduce restitution, deteriorate flight performance, and substantially lower durability, resulting in two-piece solid golf balls which not only fail to possess their characteristic excellent flight performance and durability, but also lose actual playability. More specifically, the structure of conventional two-piece solid golf balls is decided depending on which is considered important among four factors, softness, restitution, spin and durability. An attempt to improve any one factor inevitably leads to lowering of the remaining factors.

Also, as a matter of course, controllability is needed on full shots with woods such as a driver and long irons. If a soft cover is used as a result of considering too much the purpose of improving spin properties upon control shots such as approach shots with a short iron, hitting the ball with a driver, which falls within an increased deformation region, will impart too much spin so that the ball may fly too high, resulting in a rather reduced flight distance. On the other hand, if the spin rate is too low, there arises a problem that the ball on the descending course will prematurely drop, adversely affecting the ultimate flight distance too. As a consequence, an appropriate spin rate is still necessary upon hitting with a driver.

SUMMARY OF THE INVENTION

An object of the present invention is to provide a golf ball which can satisfy improved flight performance, durability, pleasant hitting feel, and controllability at the same time by optimizing the hardness distribution of the core and the overall hardness distribution of the ball including the core, intermediate layer, and cover.

Making extensive investigations on a three-piece solid golf ball of the three-layer structure comprising a solid core, an intermediate layer, and a cover for achieving the above object, we have found that by optimizing the hardness distribution of the core such that the core surface hardness is higher than the core center hardness, adjusting the intermediate layer hardness higher than the core surface hardness, and adjusting the cover hardness higher than the intermediate layer hardness, there is obtained a solid golf ball having an optimum hardness distribution to accomplish all-around performance in that the ball is improved in flight performance, durability, and controllability.

More specifically, we have found that the following advantages are obtained in a three-piece solid golf ball of the three-layer structure comprising a solid core, an intermediate layer, and a cover When the solid core, intermediate layer, and cover each have a hardness as measured by a JIS-C scale hardness meter, the core center hardness is up to 75 degrees, the core surface hardness is up to 85 degrees, the core surface hardness is higher than the core center hardness by 5 to 25 degrees, the intermediate layer hardness is higher than the core surface hardness by less than 10 degrees, and the cover hardness is higher than the intermediate layer hardness. Then first a core having an optimum hardness distribution is formed. With respect to ball deformation upon impact, the core surface formed harder than the core center is effective for preventing excessive deformation and efficiently converting distortion energy into reaction energy. Then the flying distance is increased and a soft pleasant hitting feel is obtainable from the soft core center. Additionally, second by sequentially enclosing the core formed soft with a harder intermediate layer and a cover harder than the intermediate layer, the ball as a whole is given an optimum hardness distribution. There is obtained a golf ball which minimizes the energy loss caused by excessive deformation upon impact and has efficient restitution. Moreover, in the three-piece solid golf ball having the above-defined hardness distribution, thirdly if the intermediate layer and the cover are formed mainly of a thermoplastic resin containing 10 to 100% by weight of an ionomer resin, the intermediate layer can be firmly joined to the cover, and this firm joint combined with the cover formed hard is effective for improving durability.

We have found that owing to the above three advantages accomplished by setting the hardness distribution of a three-piece solid golf ball as defined above, there is obtained a golf ball which receives an optimized spin rate upon full shots with a driver or the like so that the flying distance is outstandingly increased and which is improved in both durability and hitting feel. The present invention is predicated on these findings.

DETAILED DESCRIPTION OF THE INVENTION

Figure 1:
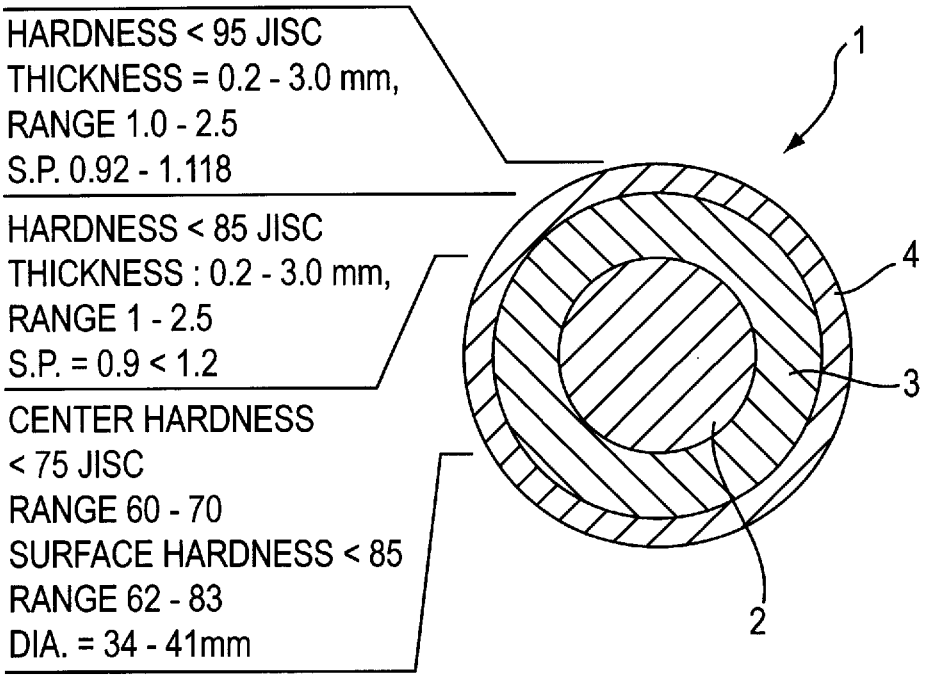
FIG. 1 is a schematic cross-sectional view of a three-piece solid golf ball according to one embodiment of the invention.

Now the present invention is described in further detail. Referring to FIG. 1, a three-piece solid golf ball 1 according to the invention is illustrated comprising a solid core 2 having an optimized hardness distribution, an intermediate layer 3 harder than the surface of the core 2, and a cover 4 harder than the intermediate layer 3.

In the golf ball 1 of the invention, the hardness distribution of the solid core 2 is optimized. More particularly, the core 2 is formed to have a center hardness of up to 75 degrees, preferably 50 to 70 degrees, more preferably 51 to 68 degrees as measured by a JIS-C scale hardness meter. (The hardness is referred to as JIS-C hardness, hereinafter.) The core 2 is also formed to have a surface hardness of up to 85 degrees, preferably 60 to 85 degrees, more preferably 62 to 83 degrees. If the center hardness exceeds 75 degrees and the surface hardness exceeds 85 degrees, the hitting feel becomes hard, contradicting the object of the invention. If the core is too soft, on the other hand, a greater deformation occurs upon impact and the flying distance and durability are reduced due to an energy loss associated therewith.

The core is formed herein such that the surface hardness is higher than the center hardness by 5 to 25 degrees, preferably 7 to 22 degrees. With a hardness difference of less than 5 degrees, the core surface hardness is approximately equal to the core center hardness, which means that the hardness distribution is nil and flat, resulting in a hard hitting feel. For a hardness difference of more than 25 degrees, the core center hardness must be too low, failing to provide sufficient restitution. The hardness distribution establishing such a hardness difference between the surface and the center of the core ensures that the core surface formed harder than the core center is effective for preventing excessive deformation of the core and efficiently converting distortion energy into reaction energy when the ball is deformed upon impact. Additionally, a pleasant feeling is obtainable from the core center softer than the core surface.

The hardness distribution of the solid core is not limited insofar as the core is formed such that the core surface is harder than the core center by 5 to 25 degrees. It is preferable from the standpoint of efficient energy transfer that the core is formed such that the core becomes gradually softer from its surface inward toward its center.

The solid core preferably has a diameter of 34 to 41 mm, especially 34 to 39 mm. No particular limit is imposed on the overall hardness, weight and specific gravity of the core and they are suitably adjusted insofar as the objects of the invention are attainable. Usually, the core has an overall hardness corresponding to a distortion of 2.3 to 5.5 mm, especially 2.5 to 4.8 mm under a load of 100 kg applied the core has a weight of 25 to 42 grams, especially 27 to 41 grams.

In the practice of the invention, no particular limit is imposed on the core-forming composition from which the solid core is formed. The solid core may be formed using a base rubber, a crosslinking agent, a co-crosslinking agent, and an inert filler as used in the formation of conventional solid cores. The base rubber used herein may be natural rubber and/or synthetic rubber conventionally used in solid golf balls although 1,4-cis-polybutadiene having at least 40% of cis-structure is especially preferred in the invention. The polybutadiene may be blended with a suitable amount of natural rubber, polyisoprene rubber, styrene-butadiene rubber or the like if desired. The crosslinking agent includes organic peroxides such as dicumyl peroxide, di-t-butyl peroxide, and 1,1-bis(t-butylperoxy)-3,3,5-trimethylcyclohexane, with a blend of dicumyl peroxide and 1,1-bis(t-butylperoxy)-3,3,5-trimethylcyclohexane being preferred. In order to form a solid core so as to have the above-defined hardness distribution, it is preferable to use a blend of dicumyl peroxide and 1,1-bis(t-butylperoxy)-3,3,5-trimethylcyclohexane as the crosslinking agent and the step of vulcanizing at 160° C. for 20 minutes. Also the difference in hardness between the core center and the core surface can be changed by suitably changing the vulcanizing temperature and time.

The co-crosslinking agent used herein is not critical. Examples include metal salts of unsaturated fatty acids, inter alia, zinc and magnesium salts of unsaturated fatty acids having 3 to 8 carbon atoms (e.g., acrylic acid and methacrylic acid), with zinc acrylate being especially preferred. It is noted that the amount of the crosslinking agent blended is suitably determined although it is usually about 7 to 45 parts by weight per 100 parts by weight of the base rubber. Examples of the inert filler include zinc oxide, barium sulfate, silica, calcium carbonate, and zinc carbonate, with zinc oxide and barium sulfate being often used. The amount of the filler blended is usually up to 40 parts by weight per 100 parts by weight of the base rubber although the amount largely varies with the specific gravity of the core and cover, the standard weight of the ball, and other factors and is not critical. In the practice of the invention, the overall hardness and weight of the core can be adjusted to optimum values by properly adjusting the amounts of the crosslinking agent and filler (typically zinc oxide and barium sulfate) blended.

The core-forming composition obtained by blending the above-mentioned components is generally milled in a conventional mixer such as a Banbury mixer and roll mill, compression or injection molded in a core mold, and then heat cured under the above-mentioned temperature condition, whereby a solid core having an optimum hardness distribution is obtainable.

The intermediate layer 3 enclosing the core 2 is formed to a JIS-C hardness of up to 85 degrees, preferably 55 to 85 degrees, more preferably 63 to 85 degrees. The intermediate layer is formed to a hardness higher than the core surface hardness by less than 10 degrees, preferably by 1 to 8 degrees. A hardness difference of 10 degrees or more fails to provide sufficient restitution. The restitution of the core can be maintained by forming the intermediate layer to a hardness higher than the core surface hardness.

The gage, specific gravity and other parameters of the intermediate layer may be properly adjusted insofar as the objects of the invention are attainable. Preferably the gage is 0.2 to 3 mm, especially 1 to 2.5 mm and the specific gravity is 0.9 to less than 1.2, especially 0.92 to 1.18.

Since the intermediate layer 3 serves to compensate for a loss of restitution of the solid core which is formed soft, it is formed of a material having improved restitution insofar as a hardness within the above-defined range is achievable. Use is preferably made of ionomer resins such as Himilan 1557, 1601, 1605, 1855, 1856, and 1706 (manufactured by Mitsui-duPont Polychemical K.K.) and Surlyn 8120 and 7930 (E.I. duPont). A thermoplastic resin containing 10 to 100% by weight, especially 30 to 100% by weight of an ionomer resin is preferably used to form the intermediate layer.

Examples of the thermoplastic resin constructing the intermediate layer other than the ionomer resin include maleic anhydride modified ethylene-alkyl unsaturated carboxylate copolymers (e.g., HPR AR201 manufactured by Mitsui-duPont Polychemical K.K.), ethylene-unsaturated carboxylic acid-alkyl unsaturated carboxylate terpolymers (e.g., Nucrel AN4307 and AN4311 manufactured by Mitsui-duPont Polychemical K.K.), polyester elastomers (e.g., Hytrel manufactured by Toray-duPont K.K.), polyamide elastomers (e.g., PEBAX 3533 manufactured by Atochem), and thermoplastic elastomers having crystalline polyethylene blocks (Dynaron 6100P, HSB604, and 4600P manufactured by Nippon Synthetic Rubber K.K.) and mixtures thereof. The amount of thermoplastic resin blended is 0 to 90% by weight, preferably 0 to 70% by weight, more preferably 5 to 70% by weight of the entire intermediate layer-forming composition.

Among the above-mentioned thermoplastic resins, the thermoplastic elastomers having crystalline polyethylene blocks include three types having a molecular structure of E-EB, E-EB-E, and E-EB-S systems wherein E represents a crystalline polyethylene block, EB represents a relatively randomly copolymerized structure consisting of ethylene and butylene, and S represents a crystalline polystyrene block. These thermoplastic elastomers can be obtained by hydrogenating polybutadiene and styrene-butadiene copolymers. In addition to the thermoplastic resin including the ionomer resin, additives, for example, an inorganic filler such as zinc oxide and barium sulfate as a weight adjuster and a coloring agent such as titanium dioxide may be added to the intermediate layer-forming composition.

The cover 4 enclosing the intermediate layer 3 must have a higher hardness than the intermediate layer. The cover is formed to a JIS-C hardness of up to 95 degrees, preferably 60 to 93 degrees, more preferably 70 to 92 degrees. If the cover has a JIS-C hardness in excess of 95 degrees, the difference in hardness between the intermediate layer and the cover would be too large, leading to poor durability and hard hitting feel. The cover is formed to a hardness higher than the intermediate layer hardness by less than 15 degrees, preferably by 1 to 13 degrees. A hardness difference of 15 degrees or more would lead to poor durability and hard hitting feel.

The gage, specific gravity and other parameters of the cover may be properly adjusted insofar as the objects of the invention are attainable. Preferably the gage is 0.2 to 3 mm, especially 1 to 2.5 mm and the specific gravity is 0.9 to less than 1.2, especially 0.92 to 1.18. The gage of the intermediate layer and cover combined is preferably 2 mm or more, especially 2.5 to 5.5 mm. A total gage of less than 2 mm would lead to a lowering of durability against club strikes.

The cover composition is not critical and the cover may be formed of any of well-known stock materials having appropriate properties as golf ball cover stocks. For example, ionomer resins, polyester elastomers, and polyamide elastomers may be used alone or in admixture with urethane resins and ethylene-vinyl acetate copolymers. Ionomer resins are especially preferred while a mixture of two or more ionomer resins may be used. Preferably the cover is formed mainly of a thermoplastic resin containing 10 to 100% by weight, especially 50 to 100% by weight of an ionomer resin.

UV absorbers, antioxidants and dispersing aids such as metal soaps may be added to the cover composition if necessary. The method of applying the cover is not critical. The cover is generally formed over the core by surrounding the core by a pair of preformed hemispherical cups followed by heat compression molding or by injection molding the cover composition over the core.

Though not critical in the present invention, it is preferable to form both the intermediate layer 3 and the cover 4 from a stock material based on a thermoplastic resin containing 10 to 100% by weight of an ionomer resin. Then the cover can be more firmly joined to the intermediate layer, and this firm joint combined with the cover formed hard is effective for improving durability. In this embodiment, it is acceptable that the proportion of ionomer resin blended is different between the intermediate layer 3 and the cover 4.

The thus obtained golf ball of the invention may be formed with a multiplicity of dimples 5 in the cover surface in a conventional manner. The ball as molded may be subject to finishing steps including buffing, painting and stamping.

While the three-piece solid golf ball of the invention is constructed as mentioned above, it preferably has an overall hardness corresponding to a distortion of 2.3 to 4.3 mm, especially 2.5 to 4 mm under a load of 100 kg applied. Ball parameters including weight and diameter are properly determined in accordance with the Rules of Golf.

The three-piece solid golf ball of the invention has improved flight performance, durability, and soft pleasant hitting feel. Especially upon full shots with a driver or the like, the ball is optimized in spin rate and thus improved in flight performance and hitting feel.

EXAMPLE

Examples of the present invention are given below together with Comparative Examples by way of illustration and not by way of limitation. The amounts of components in the core, intermediate layer, and cover as reported in Tables 1 and 2 are all parts by weight.

Example and Comparative Example

Solid cores, Nos. 1 to 13, were prepared by kneading components in the formulation shown in Table 1 to form a rubber composition and molding and vulcanizing it in a mold under conditions as shown in Table 1. The cores were measured for JIS-C hardness and diameter, with the results shown in Tables 3 and 4. The JIS-C hardness of the core was measured by cutting the core into halves, and measuring the hardness at the center (center hardness) and the hardness at core surface or spherical surface (surface hardness). (The result is an average of five measurements.)

TABLE 1

| Core No. | 1 | 2 | 3 | 4 | 5 | 6 | 7 | 8 | 9 | 10 | 11 | 12 | 13 |
|---|---|---|---|---|---|---|---|---|---|---|---|---|---|
| Cis-1,4-polybutadiene rubber | 100 | 100 | 100 | 100 | 100 | 100 | 100 | 100 | 100 | 100 | 100 | 100 | 100 |
| Zinc acrylate | 22 | 17 | 25 | 14 | 33 | 27 | 20 | 13 | 33 | 37 | 33 | 22 | 24 |
| Zinc oxide | 28.5 | 33 | 33.5 | 28.5 | 25.5 | 39.5 | 32.5 | 22.5 | 20.5 | 17 | 7 | 33 | 28.2 |
| Dicumyl peroxide | 1 | 1 | 1 | 1 | 1 | 1 | 1 | 1 | 1 | 1 | 1 | 1 | 1 |
| *1 | 0.3 | 0.3 | 0.3 | 0.3 | 0.3 | 0.3 | 0.3 | 0.3 | 0.3 | 0.3 | 0.3 | 0.3 | 0.3 |

TABLE 1-continued

| Core No. | 1 | 2 | 3 | 4 | 5 | 6 | 7 | 8 | 9 | 10 | 11 | 12 | 13 |
|---|---|---|---|---|---|---|---|---|---|---|---|---|---|
| Vulcanizing conditions | | | | | | | | | | | | | |
| Temperature, °C. | 160 | 160 | 160 | 160 | 160 | 120 | 160 | 160 | 160 | 150 | 160 | 120 | 160 |
| Time, min. | 20 | 20 | 20 | 20 | 20 | 80 | 20 | 20 | 20 | 30 | 20 | 80 | 20 |

*1 1,1-bis(t-butylperoxy)-3,3,5-trimethylcyclohexane (trade name Perhexa 3M-40 manufactured by Nippon Oil and Fats K.K.)

Next, compositions for the intermediate layer and cover were milled as shown in Table 2 and injection molded over the solid core and the intermediate layer, respectively, obtaining three-piece solid golf balls as shown in Tables 3 and 4. Whenever the intermediate layer and cover were molded, the intermediate layer and cover were measured for JIS-C hardness, specific gravity and gage. The results are also shown in Tables 3 and 4.

Ball hardness

A distortion (mm) under a load of 100 kg was measured.

Flight performance

Using a hitting machine manufactured by True Temper Co., the ball was actually hit with a driver (#W1) at a head speed of 45 m/s (HS45) and 35 m/sec. (HS35) to measure a spin, carry, and total distance.

The club used was "PRO230TITAN" having a loft angle of 11°, shaft of Harmotec Light HM50J(HK), hardness S, and balance D2 (manufactured by Bridgestone Sports Co.) for HS45 hitting and "ESSERIO" having a loft angle of 14° and shaft hardness R (manufactured by Bridgestone Sports Co.) for HS35 hitting.

TABLE 2

| Intermediate layer or Cover No. | A | B | C | D | E | F | G | H | I | J | K | L | M | N | O |
|---|---|---|---|---|---|---|---|---|---|---|---|---|---|---|---|
| Himilan 1557*2 | | | | | 50 | | | | | 50 | 20 | | | | |
| Himilan 1601*2 | | | | | 50 | | | | | | | | | | |
| Himilan 1605*2 | 35 | | | | | | | | | 50 | | 40 | 10 | | |
| Himilan 1855*2 | | 50 | | | | | | | | | 30 | | | | |
| Himilan 1856*2 | | | | | | | | | | | | | | | |
| Himilan 1706*2 | 35 | | | | | | | | | | | 30 | | | |
| Himilan 1707*2 | | | | | | | | | | | | 30 | | | |
| Surlyn 8120*3 | | 50 | | 100 | | | | | | | 50 | | 90 | | |
| HPR AR201*4 | 30 | | | | | | | | | | | | | | |
| Nuclel AN4307*5 | | | 36 | | | | | | | | | | | | |
| Nuclel AN4311*5 | | | | | | | | | | | | | | | 26 |
| Surlyn 7930*3 | | | 32 | | | | | | | | | | | | 37 |
| Himilan AM7311*2 | | | 32 | | | | | | | | | | | | 37 |
| Hytrel 4047*6 | | | | | | 100 | | | | | | | | | |
| PEBAX3533*7 | | | | | | | | | 100 | | | | | | |
| Surlyn AD8511*3 | | | | | | | | | | | | | | 35 | |
| Surlyn AD8512*3 | | | | | | | | | | | | | | 35 | |
| Dynalon 6100P*8 | | | | | | | | | | | | | | 30 | |
| Titanium dioxide | 4 | 4 | 4 | 4 | 4 | 4 | | | 4 | 4 | 4 | 4 | 4 | 4 | 4 |
| Cis-1,4-polybutadiene rubber | | | | | | | 100 | 100 | | | | | | | |
| Zinc acrylate | | | | | | | 40 | 36 | | | | | | | |
| Zinc oxide | | | | | | | 31 | 32.5 | | | | | | | |
| Dicumyl peroxide | | | | | | | 1 | 1 | | | | | | | |
| *9 | | | | | | | 0.3 | 0.3 | | | | | | | |

*2 ionomer resin manufactured by Mitsui-duPont Polychemical K.K.

*3 ionomer resin manufactured by E.I. duPont of USA

*4 maleic anhydride modified ethylene-ethyl acrylate copolymer manufactured by Mitsui-duPont Polychemical K.K.

*5 ethylene-methacrylic acid-acrylate terpolymer manufactured by Mitsui-duPont Polychemical K.K.

*6 polyester elastomer manufactured by Toray-duPont K.K.

*7 polyamide elastomer manufactured by Atochem.

*8 hydrogenated polybutadiene block copolymer of E-EB-E system manufactured by Nippon Synthetic Rubber K.K.

*9 same as *1 in Table 1

The thus obtained golf balls were evaluated for hardness, flight performance, spin, feel, and durability by the following tests.

Feel

Five golfers with a head speed of 45 m/sec. (HS45) and five golfers with a head speed of 35 m/sec. (HS35) actually hit the balls. The ball was rated according to the following criterion.

○: soft

Δ: ordinary

X: hard

Durability

Durability against continuous strikes and durability against cutting were evaluated in combination. The ball was rated according to the following criterion.

○: excellent

Δ: ordinary

X: inferior

TABLE 3

| Examples | | 1 | 2 | 3 | 4 | 5 | 6 | 7 |
|---|---|---|---|---|---|---|---|---|
| Core | Type | 1 | 2 | 3 | 4 | 5 | 1 | 13 |
| | Center hardness A (JIS-C) | 63 | 55 | 63 | 52 | 65 | 63 | 66 |
| | Surface hardness B (JIS-C) | 74 | 70 | 74 | 66 | 80 | 74 | 76 |
| | Hardness difference B-A (JIS-C) | 11 | 15 | 11 | 14 | 15 | 11 | 10 |
| | Diameter (mm) | 36.5 | 36.1 | 35.1 | 37.9 | 36.5 | 36.5 | 36.5 |
| Intermediate layer | Type | A | B | C | D | E | N | N |
| | Hardness C (JIS-C) | 76 | 75 | 80 | 70 | 84 | 80 | 80 |
| | Hardness difference from core surface C-B (JIS-C) | 2 | 5 | 6 | 4 | 4 | 6 | 4 |
| | Specific gravity | 0.97 | 0.97 | 0.97 | 0.97 | 0.97 | 0.97 | 0.97 |
| | Gage (mm) | 1.6 | 1.6 | 1.8 | 1.2 | 1.6 | 1.6 | 1.6 |
| Cover | Type | C | E | J | K | J | O | O |
| | Hardness (JIS-C) | 80 | 84 | 86 | 76 | 86 | 86 | 86 |
| | Specific gravity | 0.97 | 0.97 | 0.97 | 0.97 | 0.97 | 0.97 | 0.97 |
| | Gage (mm) | 1.5 | 1.7 | 2.0 | 1.2 | 1.5 | 1.5 | 1.5 |
| Ball (entirety) | Diameter (mm) | 42.7 | 42.7 | 42.7 | 42.7 | 42.7 | 42.7 | 42.7 |
| | Hardness @ 100 kg (mm) | 3.0 | 3.4 | 2.8 | 3.7 | 2.6 | 3.0 | 2.9 |
| #W1/HS45 | Spin (rpm) | 2800 | 2650 | 2750 | 2700 | 2900 | 2780 | 2720 |
| | Carry (m) | 209.0 | 209.0 | 210.0 | 208.5 | 210.5 | 209.8 | 210.0 |
| | Total (m) | 223.0 | 223.5 | 224.5 | 222.0 | 224.0 | 224.0 | 225.0 |
| | Feel | ○ | ○ | ○ | ○ | ○ | ○ | ○ |
| #W1/HS35 | Spin (rpm) | 4600 | 4400 | 4550 | 4700 | 4650 | 4595 | 4510 |
| | Carry (m) | 143.0 | 144.0 | 143.5 | 144.0 | 143.0 | 143.3 | 144.5 |
| | Total (m) | 150.0 | 153.0 | 150.0 | 152.5 | 152.0 | 149.9 | 154.0 |
| | Feel | ○ | ○ | ○ | ○ | Δ | ○ | ○ |
| Durability | | ○ | ○ | ○ | ○ | ○ | ○ | ○ |

TABLE 4

| Comparative Examples | | 1 | 2 | 3 | 4 | 5 | 6 | 7 |
|---|---|---|---|---|---|---|---|---|
| Core | Type | 6 | 7 | 8 | 9 | 10 | 11 | 12 |
| | Center hardness A (JIS-C) | 72 | 59 | 50 | 65 | 77 | 65 | 67 |
| | Surface hardness B (JIS-C) | 74 | 74 | 65 | 80 | 86 | 80 | 69 |
| | Hardness difference B-A (JIS-C) | 2 | 15 | 15 | 15 | .9 | 15 | 2 |
| | Diameter (mm) | 33[7] | 33.7 | 33.3 | 38.3 | 38.7 | 30.1 | 35.5 |
| Intermediate layer | Type | C | F | G | — | B | H | I |
| | Hardness C (JIS-C) | 80 | 64 | 86 | — | 75 | 80 | 67 |
| | Hardness difference from core surface C-B (JIS-C) | 6 | −10 | 21 | — | −11 | 0 | -2 |
| | Specific gravity | 0.97 | 1.12 | 1.25 | — | 0.97 | 1.25 | 1.01 |
| | Gage (mm) | 2.5 | 2.5 | 2.5 | — | 0.8 | 4.1 | 1.8 |
| Cover | Type | J | K | K | L | K | K | M |
| | Hardness (JIS-C) | 86 | 92 | 92 | 92 | 92 | 92 | 71 |
| | Specific gravity | 0.97 | 0.97 | 0.97 | 0.97 | 0.97 | 0.97 | 0.97 |
| | Gage (mm) | 2.0 | 2.0 | 2.2 | 2.2 | 1.2 | 2.2 | 2.0 |
| Ball (entirety) | Diameter (mm) | 42.7 | 42.7 | 42.7 | 42.7 | 42.7 | 42.7 | 42.7 |
| | Hardness @ 100 kg (mm) | 2.1 | 3.4 | 2.9 | 3.0 | 2.2 | 2.5 | 2.9 |
| #W1/HS45 | Spin (rpm) | 3100 | 2650 | 2600 | 2600 | 3200 | 2700 | 3300 |
| | Carry (m) | 206.0 | 207.0 | 207.0 | 206.5 | 207.0 | 205.0 | 205.0 |
| | Total (m) | 219.0 | 222.0 | 221.0 | 220.0 | 219.5 | 220.0 | 217.0 |
| | Feel | X | ○ | ○ | ○ | X | Δ | ○ |
| #W1/HS35 | Spin (rpm) | 4750 | 4200 | 4300 | 4300 | 4800 | 4500 | 4900 |
| | Carry (m) | 138.0 | 140.0 | 139.0 | 137.0 | 136.0 | 134.5 | 135.0 |
| | Total (m) | 145.0 | 149.0 | 148.0 | 147.0 | 141.0 | 141.0 | 140.0 |
| | Feel | X | ○ | Δ | ○ | X | X | ○ |
| Durability | | ○ | X | X | X | Δ | Δ | ○ |

As is evident from Tables 3 and 4, in Comparative Examples 1 and 7, the core does not have an optimum hardness distribution since the difference between core surface hardness and core center hardness is small. Additionally, in Comparative Example 7, the core surface is harder than the intermediate layer. In Comparative Examples 2, 5, and 6, the core surface is harder than or equal to the intermediate layer. In Comparative Example 3, the intermediate layer is harder than the core surface. Comparative Example 4 is a two-piece solid golf ball. In Comparative Example 5, both the core center and surface are hard. For these factors, the golf balls of Comparative Examples 1 to 7 fail to fully satisfy some or all of flight distance, feel, durability and appropriate spin rate upon full shots with a driver or show considerably inferior results.

In contrast, the golf balls of Examples 1 to 7 within the scope of the invention were acknowledged to produce an appropriate spin rate upon full shots with a driver to cover a longer flight distance and be excellent in both hitting feel and durability.

We Claim:

1. A three-piece solid golf ball of the three-layer structure comprising, a solid core, an intermediate layer, and a cover, wherein the solid core, intermediate layer, and cover each have a hardness as measured by a JIS-C scale hardness meter wherein the core center hardness is up to 75 degrees, the core surface hardness is up to 85 degrees, the core surface hardness is higher than the core center hardness by 5 to 25 degrees, the intermediate layer hardness being higher than the core surface hardness by less than 10 degrees, and the cover hardness being higher than the intermediate layer hardness wherein said solid core is formed of an elastomer comprising cis-1,4-polybutadiene as a main component and the core has a diameter of 34 to 41 mm.

2. The three-piece solid golf ball of claim 1 wherein said intermediate layer is based on a thermoplastic resin containing 10 to 100% by weight of an ionomer resin and has a hardness of up to 85 degrees as measured by the JIS-C scale hardness meter.

3. The three-piece solid golf ball of claim 1 wherein said intermediate layer has a gage of 0.2 to 3 mm and a specific gravity of 0.9 to less than 1.2.

4. The three-piece solid golf ball of claim 1 wherein said cover is based on a thermoplastic resin containing 10 to 100% by weight of an ionomer resin and has a hardness of up to 95 degrees as measured by the JIS-C scale hardness meter.

5. The three-piece solid golf ball of claim 1 wherein said cover has a gage of 0.2 to 3 mm and a specific gravity of 0.9 to less than 1.2.

6. The three-piece solid golf ball of claim 1 wherein said intermediate layer and said cover combined have a total gage of at least 2 mm.

7. The three-piece solid golf ball of claim 1 wherein said core center hardness is in the range of 50 to 70 on JIS-C and the surface hardness of said core is in the range of 62 to 83 on JIS-C.

8. The three-piece solid golf ball of claim 1 wherein said core surface hardness is higher than the core center hardness by 7 to 22 degrees on JIS-C.

9. The three-piece solid golf ball of claim 1 wherein said solid core has an overall distortion in the range of 2.5 to 4.8 mm under an applied load of 100 kg.

10. The three-piece solid golf ball of claim 1 wherein said intermediate layer has a hardness greater than the core surface hardness by less than 1 to 8 degrees on JIS-C.

11. The three-piece solid golf ball of claim 1 wherein said intermediate layer has a gage in the range of 1 to 2.5 mm and a specific gravity in the range of 0.92–1.18.

12. The three-piece solid golf ball of claim 1 wherein said cover has a hardness in the range of 60 to 93 degrees on JIS-C.

13. The three-piece solid golf ball of claim 1 wherein said cover has a gage in the range of 1.0 to 2.5 mm and a specific gravity in the range of 0.92 to 1.118.

* * * * *